US006532922B2

(12) United States Patent
Komazawa

(10) Patent No.: US 6,532,922 B2
(45) Date of Patent: Mar. 18, 2003

(54) VARIABLE VALVE TIMING CONTROL DEVICE

(75) Inventor: Osamu Komazawa, Chita (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/079,870

(22) Filed: Feb. 22, 2002

(65) Prior Publication Data

US 2002/0124821 A1 Sep. 12, 2002

(30) Foreign Application Priority Data

Feb. 22, 2001 (JP) ..... 2001-046981

(51) Int. Cl.[7] ..... F01L 1/34

(52) U.S. Cl. ..... 123/90.17; 123/90.15; 123/90.16; 123/90.31; 123/90.65

(58) Field of Search ..... 123/90.17, 90.16, 123/90.15, 90.65, 90.37, 90.31; 74/568 R

(56) References Cited

U.S. PATENT DOCUMENTS 6,129,062 A * 10/2000 Koda ..... 123/90.17

FOREIGN PATENT DOCUMENTS

JP 9-324613 A 12/1997

* cited by examiner

*Primary Examiner*—Thomas Denion
*Assistant Examiner*—Kyle Riddle
(74) *Attorney, Agent, or Firm*—Burns, Doane, Swecker & Mathis, LLP

(57) ABSTRACT

A variable valve timing control device includes a relative rotation control mechanism restricting relative rotation between the housing member and the rotor member at an intermediate phase position between a most advanced angle phase position and a most retarded angle phase position, and a hydraulic pressure circuit which controlling supply and discharge of operation fluid with respect to advance and retarded angle hydraulic chambers while also controlling supply and discharge of operation fluid for the relative rotation control mechanism. The hydraulic pressure circuit includes a variable type spool valve adapted to discharge the operation fluid from the advance and retarded angle chambers and from the relative rotation control mechanism. The variable type spool valve has different discharge opening widths at a both drain function region in which the operation fluid can be drained from the advanced and retarded angle hydraulic chambers.

14 Claims, 7 Drawing Sheets

VARIABLE VALVE TIMING CONTROL DEVICE

This application is based on and claims priority under 35 U.S.C. §119 with respect to Japanese No. 2001-046981 filed on Feb. 22, 2001, the entire content of which is incorporated herein by reference.

FIELD OF THE INVENTION

This invention generally relates to intake and exhaust valves of a vehicle engine. More particularly, the invention pertains to a variable valve timing control device for controlling the opening and closing timing of an intake valve and an exhaust valve of a vehicle engine.

BACKGROUND OF THE INVENTION

A known variable valve timing control device is described in Japanese Patent Laid-Open Publication No. H09-324613. This disclosed variable valve timing control device is provided in connection with the drive train that transmits a driving force from a crankshaft of an engine to a camshaft for opening and closing an intake valve or an exhaust valve of the engine. The known variable valve timing control device includes a housing member unitarily rotated with the crankshaft and the camshaft and a rotor member assembled for relative rotation in the housing member for forming a hydraulic pressure chamber between the housing. A vane portion divides the hydraulic pressure chamber into an advanced angle hydraulic chamber and a retarded angle hydraulic chamber, and unitarily rotates with the camshaft and the crankshaft. The variable valve timing control device further includes a relative rotation control mechanism for restricting relative rotation between the housing member and the rotor member at an intermediate phase position (i.e., lock position) between a most advanced phase angle and a most retarded phase angle by a locking operation by virtue of the exhaust of an operation fluid and for allowing the relative rotation between the hosing member and the rotor member by an unlocking operation by virtue of supplying the operation fluid. The variable valve timing control device still further includes a hydraulic pressure circuit for controlling the supply and the discharge of the operation fluid to the advanced angle hydraulic chamber and the retarded angle hydraulic chamber, and for controlling the supply and the discharge of the operation fluid of the relative rotation control mechanism.

According to the aforementioned variable valve timing control device, the opening and closing timing (i.e., valve timing) of the intake valve or the exhaust valve is predetermined to achieve a preferable starting performance of the engine under the condition that the relative rotation between the housing member and the rotor member is restricted at the intermediate phase position between the most advanced angle phase position and the most retarded angle phase position by the relative rotation control mechanism. Thus, the starting performance of the engine may deteriorate in case the relative rotation control mechanism does not restrict the relative rotation between the housing member and the rotor member at the intermediate phase position upon the starting of the engine.

Factors associated with disturbing the restricting of the relative rotation between the housing member and the rotor member by the relative rotation control mechanism at the starting of the engine derive from the setting of the hydraulic pressure circuit and the residual operation fluid in the advanced angle hydraulic chamber and the retarded angle hydraulic chamber and the relative rotation control mechanism. According to known hydraulic pressure circuits, it is predetermined that the operation fluid is supplied to the advanced angle hydraulic chamber and to the retarded angle hydraulic chamber during the de-energization of a control valve provided in the hydraulic pressure circuit. In this type of hydraulic pressure circuit, the rotor member may not rotate relative to the housing member to be at the intermediate phase position by the supply of the operation fluid to the advanced angle hydraulic chamber or to the retarded angle hydraulic chamber when the control valve is under de-energization at starting of the engine.

A need thus exists for a variable valve timing control device which is not as susceptible to drawbacks mentioned above.

SUMMARY OF THE INVENTION

According to one aspect, a variable valve timing control device includes a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft, and a rotor member relatively rotatably assembled in the housing member for forming a hydraulic pressure chamber with the housing member. The rotor member has a vane portion for dividing the hydraulic pressure chamber into an advanced angle hydraulic chamber and a retarded angle hydraulic chamber. The variable valve timing control device further includes a relative rotation control mechanism for allowing relative rotation between the housing member and the rotor member by performing an unlocking operation through supply of an operation fluid and for restricting relative rotation between the housing member and the rotor member at an intermediate phase position between a most advanced angle phase position and a most retarded angle phase position by the discharge of the operation fluid. A hydraulic pressure circuit controls the supply and discharge of the operation fluid of the advanced angle hydraulic chamber and the retarded angle hydraulic chamber, and controls the supply and discharge of the operation fluid of the relative rotation control mechanism. A control valve provided in the hydraulic pressure circuit discharges the operation fluid from the advanced angle hydraulic chamber and the retarded angle hydraulic chamber and from the relative rotation control mechanism. The control valve includes a variable electromagnetic spool valve having different exhaust opening widths at a both drain function region at which the operation fluid is discharged from the advanced angle hydraulic chamber and the retarded angle hydraulic chamber, and has a larger opening for a passage in communication with the retarded angle hydraulic chamber or the advanced angle hydraulic chamber whose volume is large at idling of the internal combustion engine.

According to another aspect, a variable valve timing control device includes a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft, and a rotor member relatively rotatably assembled in the housing member to define with the housing member a hydraulic pressure chamber. The rotor member has a vane portion dividing the hydraulic pressure chamber into an advanced angle hydraulic chamber and a retarded angle hydraulic chamber. A relative rotation control mechanism permits relative rotation between the housing member and the rotor member by effecting an unlocking operation between the housing member and the rotor member through supply of operation fluid, and restricts relative rotation between the housing member and the rotor member at an intermediate phase position between a most advanced angle phase position and a most retarded angle phase position by effecting a locking operation between the housing member and the rotor member through discharge of operation fluid. A hydraulic pressure circuit controls the supply and discharge of the operation fluid with respect to the advanced angle hydraulic chamber and the retarded angle hydraulic chamber and controls the supply and discharge of the operation fluid with respect to the relative rotation control mechanism. An electromagnetic spool valve provided in the hydraulic pressure circuit includes a spool that is positioned during de-energization of the variable type electromagnetic spool valve at a position forming a both drain function region in which the operation fluid is discharged from the advanced angle hydraulic chamber and the retarded angle hydraulic chamber.

In accordance with another aspect, a variable valve timing control device includes a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft, and a rotor member relatively rotatably assembled in the housing member to define with the housing member a hydraulic pressure chamber, with the rotor member having a vane portion dividing the hydraulic pressure chamber into an advanced angle hydraulic chamber and a retarded angle hydraulic chamber. A relative rotation control mechanism permits relative rotation between the housing member and the rotor member by effecting an unlocking operation between the housing member and the rotor member through supply of operation fluid, and restricts relative rotation between the housing member and the rotor member at an intermediate phase position between a most advanced angle phase position and a most retarded angle phase position by effecting a locking operation between the housing member and the rotor member through discharge of operation fluid. A hydraulic pressure circuit controls the supply and discharge of the operation fluid with respect to the advanced angle hydraulic chamber and the retarded angle hydraulic chamber, and also controls the supply and discharge of the operation fluid with respect to the relative rotation control mechanism. An electromagnetic spool valve is provided in the hydraulic pressure circuit and includes a spool moved in response to energization of the electromagnetic spool valve. The spool is movable to a maximum moved position during energization of the variable type electromagnetic spool valve, with the maximum moved position constituting a both drain function region at which the operation fluid is discharged from the advanced angle hydraulic chamber and the retarded angle hydraulic chamber. The spool is positioned during de-energization of the electromagnetic spool valve at a position constituting a supply-drain function region at which operation fluid is supplied to one of the advanced angle hydraulic chamber and the retarded angle hydraulic chamber, and is drained from the other of the advanced angle hydraulic chamber and the retarded angle hydraulic chamber.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
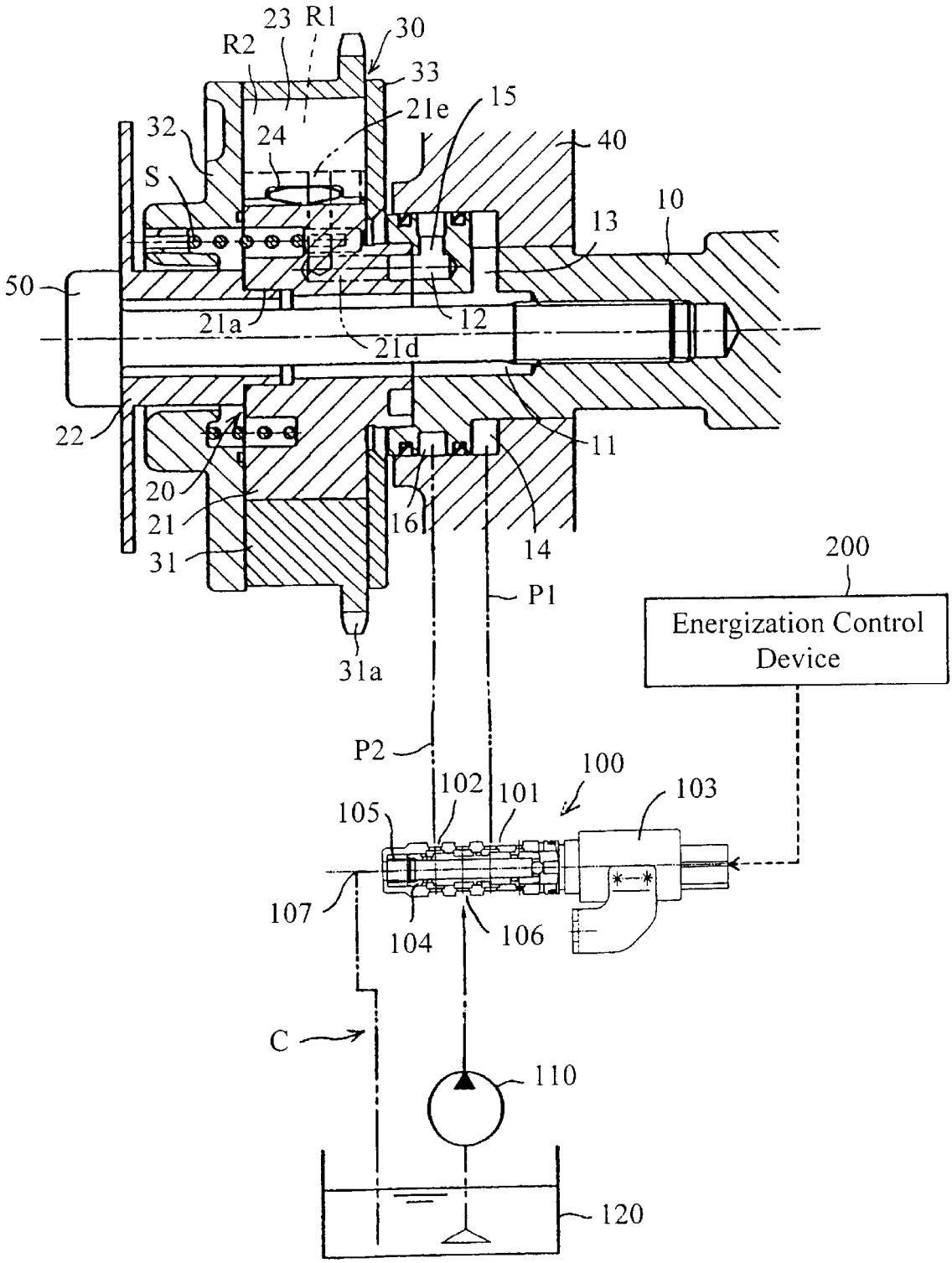
FIG. 1 is a cross-sectional view of an embodiment of the variable valve timing control device according to the invention.

Referring initially to FIGS. 1–5, an embodiment of a variable valve timing control device for an internal combustion engine in accordance with the present invention includes a rotation member 20 assembled as one unit with a tip portion (i.e., left end portion in FIG. 1) of a camshaft 10, a housing member 30 outfitted to the rotor member 20 within a predetermined range, a torsion spring S provided between the housing member 30 and the rotor member 20, a relative rotation control mechanism B for controlling relative rotation between the housing 30 and the rotor 20, and a hydraulic pressure circuit C for controlling the supply and discharge of the operation fluid to an advanced angle hydraulic chamber R1 and a retarded angle hydraulic chamber R2 and for controlling the supply and the discharge of the operation fluid to the relative rotation control mechanism B.

The camshaft 10 includes a known cam (not shown) for opening and closing an intake valve and is rotatably supported by a cylinder head 40 of the internal combustion engine. The camshaft 10 is provided with an advanced angle conduit 11 and a retarded angle conduit 12 which extend in the axial direction of the camshaft 10. The advanced angle conduit 11 is operatively connected with the advanced angle portion 101 of the hydraulic pressure control valve 100 via a communication bore 13 extending in the radial direction, an annular passage 14, and a connecting passage P1. The retarded angle conduit 12 is operatively connected with the retarded angle port 102 of the hydraulic pressure control valve 100 via a communication bore 15 extending in the radial direction, an annular passage 16, and a connecting passage P2. The communication bores 13, 15 extending in the radial direction and the annular passage 16 are formed on the camshaft 10, and the annular passage 14 is formed at a stepped portion between the camshaft 10 and the cylinder head 40.

The rotor member 20 includes a main rotor 21 and a stepped cylindrical front rotor 22 which is assembled as one unit with the front portion of (i.e., the leftward of FIG. 1) of the main rotor 21. The main rotor 21 and the front rotor 22 are unitarily secured to the front end of the camshaft 10 with a bolt 50. Central inner bores of each rotor 21, 22 are closed at their front end by a head portion of the bolt 50 and are in communication with the advanced angle conduit 11 provided on the camshaft 10.

The main rotor 21 includes an inner bore 21*a* assembled coaxially to the front rotor 22 and four vane grooves 21*b* for being assembled with or receiving respective ones of four vanes 23, and springs 24 for biasing the vanes 23 in the radially outward direction. Each vane 23 extends in the radially outward direction in the respective vane groove 21*b* for parting or defining the advanced angle hydraulic chamber R1 and the retarded angle hydraulic chamber R2 in the housing member 30.

The main rotor 21 further includes four communication bores 21*c* extending in the radial direction. The inner radial end of the communication bores 21*c* are in communication with the advanced angle conduit 11 via the central inner bore. The outer radial end of the communication bores 21*c* are in communication with the advanced angle hydraulic chamber R1. The main rotor 21 still further includes four communication bores 21*d* extending in the axial direction and in communication with the retarded angle conduit 12, and four communication bores 21*e* extending in the radial direction. The inner radial end of the communication bores 21*e* are in communication with the communication bore 21*d* and the outer radial end of the communication bores 21*e* are in communication with the retarded angle hydraulic chamber R2.

The housing member 30 includes a housing body 31, a front plate 32, a rear plate 33, and five bolts 34 (shown in FIG. 2) connecting the housing body 31, the front plate 32, and the rear plate 33 as one unit. A sprocket 31*a* is unitarily formed on the rear outer periphery of the housing body 31. The sprocket 31*a* is connected to a crankshaft of the internal combustion engine via a timing chain to be rotated in the clockwise direction of FIG. 2 by the transmitted driving force from the crankshaft.

Figure 2:
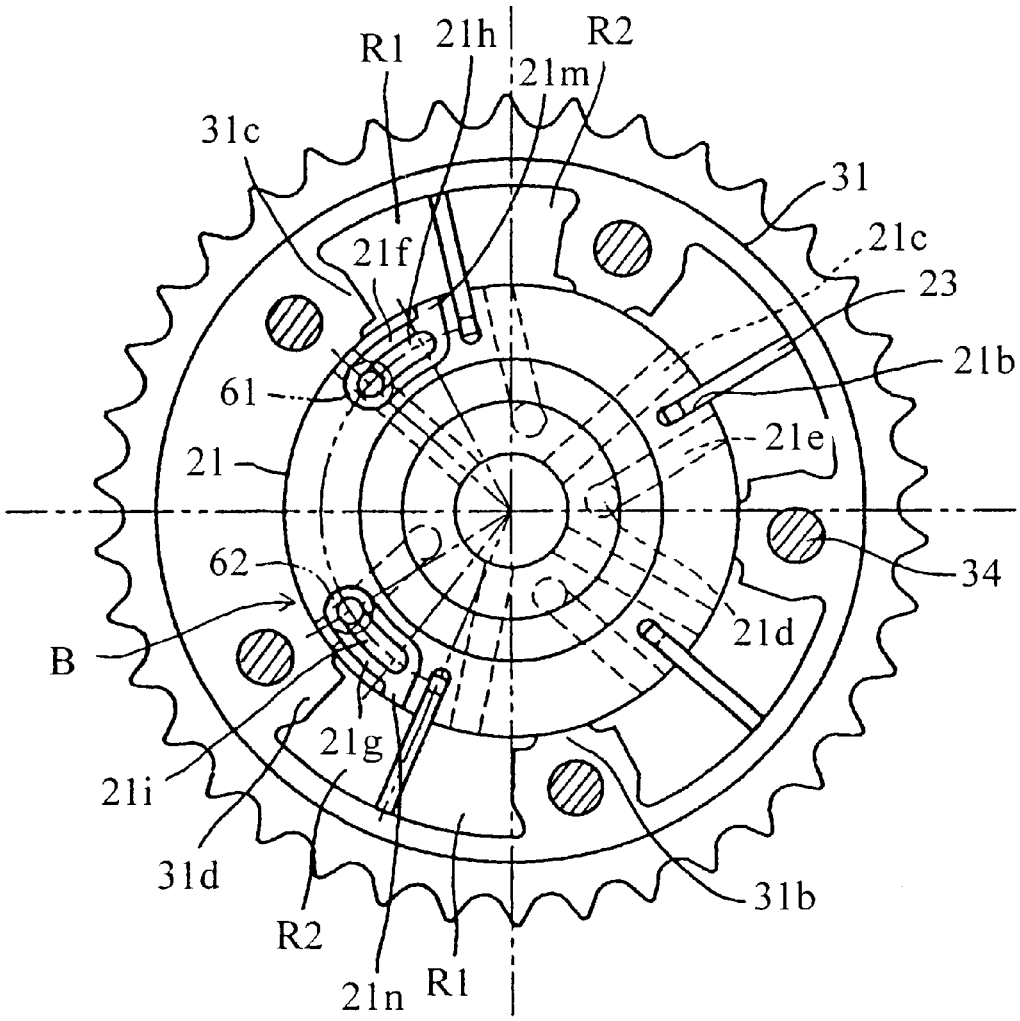
FIG. 2 is a partial cross-sectional front view of the variable valve timing control device of FIG. 1.

The housing body 31 includes four radially inwardly projecting shoe portions 31*b* for rotatably supporting the main rotor 21 at the radial inner end of each shoe portion 31*b*. The front plate 32 and the rear plate 33 slidably contact the axial outer end surfaces of the main rotor 21 and the whole end surface of the vanes 23 at opposing axial end surfaces. The housing body 31 includes projections 31*c* for restricting or defining the most retarded angle phase position through contact with the vanes 23 as shown in FIG. 2 and projections 31*d* for restricting or defining the most advanced angle phase position through contact with the vanes 23.

Figure 3:
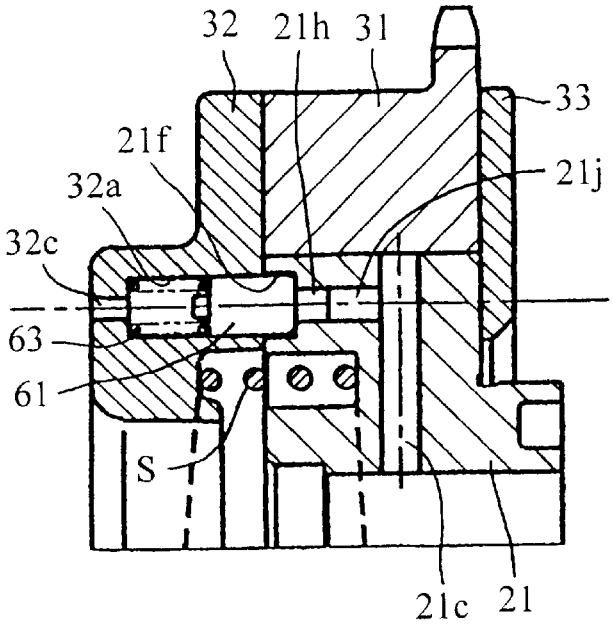
FIG. 3 is a cross-sectional view of the upper lock pin portion of the variable valve timing control device of FIG. 1.
Figure 4:
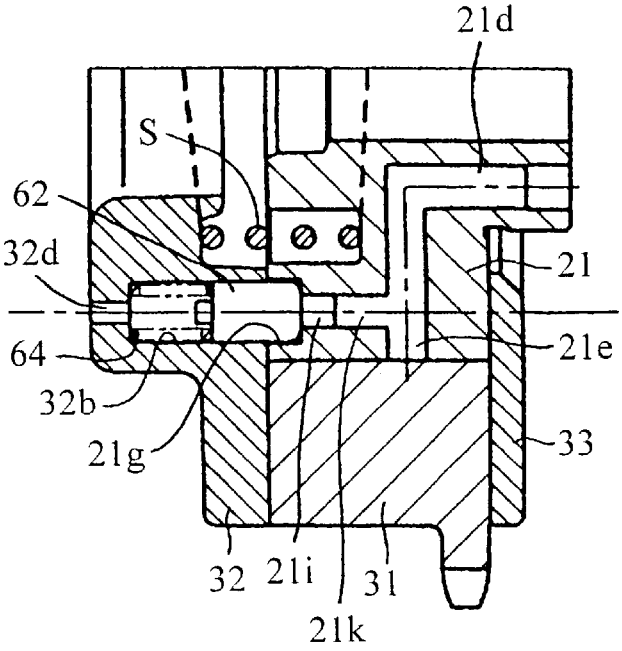
FIG. 4 is a cross-sectional view of the bottom lock pin portion of the variable valve timing control device of FIG. 1.

The relative rotation control mechanism B allows relative rotation between the housing member 30 and the rotor member 20 by performing the unlocking operation through the supply of operation fluid and restricts relative rotation between the housing member 30 and the rotor 20 at an intermediate phase position (i.e., lock position indicated by the condition shown in FIG. 2) between the most advanced angle phase position and the most retarded angle phase position by performing the locking operation through the discharging of the operation fluid. As shown in FIGS. 2–4, the relative rotation control mechanism includes two pairs of lock pins 61, 62 and lock springs 63, 64.

The lock pins 61, 62 are axially slidably assembled in respective axially oriented retraction communication bores 32*a*, 32*b* formed in the front plate 32. The lock pins 61, 62 are biased to project from the retraction communication bores 32*a*, 32*b* by the lock springs 63, 64 that are accommodated in the retraction communication bores 32*a*, 32*b*. The retraction communication bores 32*a*, 32*b* are provided with communication bores 32*c*, 32*d* for facilitating relatively smooth axial movement of the lock pins 61, 62.

The tip portions of the lock pins 61, 62 are slidable into arc-shaped lock grooves 21*f*, 21*g* formed on the main rotor 21. The lock pins 61, 62 are retracted to be accommodated in the retraction communication bores 32*a*, 32*b* by moving in the axial direction against the biasing force of the lock springs 63, 64, which is predetermined to be a relatively small value, by the supply of the operation fluid to the arc-shaped lock grooves 21*f*, 21*g*. The tip portions of the lock pins 61, 62 are contactable with the end surface of the main rotor 21 and are slidable relative thereto when contacting the end portion of the main rotor 21.

As shown in FIGS. 2 and 3, the end portions of the arc-shaped lock grooves 21*f*, 21*g* face the retraction communication bores 32*a*, 32*b* when the rotor member 20 is at the intermediate phase position relative to the housing member 30. Arc-shaped communication grooves 21*h*, 21*i* and communication bores 21*j*, 21*k* are also provided in the main rotor 21. As shown in FIGS. 2 and 3, the arc-shaped lock groove 21*f* is in communication with the advanced angle conduit 11 via the arc shaped communication groove 21*h*, the axially extending communication bore 21*j* and the radially extending communication bore 21*c*. The arc-shaped lock groove 21*f* is also in communication with the advanced angle hydraulic chamber R1 via a communication groove 21*m* extending in the radially outer direction.

As shown in FIGS. 2 and 4, the arc-shaped lock groove 21*g* is in communication with the retarded angle groove 12 via the arc-shaped communication groove 21*i*, the axially extending communication bore 21*k*, the radially extending communication bore 21*e* and the axially extending communication bore 21*d*. The arc-shaped lock groove 21*g* is in communication with the retarded angle hydraulic chamber R2 via a communication groove 21*n* extending in the radial outer direction.

The torsion spring S provided between the housing member 30 and the rotor member 20 biases the rotor member 20 rotationally towards the advanced angle side relative to the housing member 30. The biasing force of the torsion spring S is predetermined to be a degree to cancel the biased rotation of the camshaft 10 and the rotor member 20 to the retarded angle side due to the biasing force of a spring (not shown) biasing the intake valve in the closing direction. Thus, the operation response when changing the relative rotation phase of the rotor member 20 to the housing member 30 to the advanced angle side is preferable.

As shown in FIG. 1, the hydraulic pressure circuit C includes a hydraulic pressure control valve 100, an oil pump 110 actuated by the internal combustion engine, and the oil reservoir 120 of the internal combustion engine. The hydraulic pressure control valve 100 corresponds to the variable type electromagnetic spool valve for moving a spool 104 in the left direction of FIG. 1 against the biasing force of a spring 105 through energization of the solenoid 103 by an energization control device 200. By changing the change-over value (i.e., shown by percentage), the stroke amount (i.e., movement amount in the left direction of FIG. 1) of the spool 104 is changed to control the communication and discommunication between each of the ports 101, 102, 106, 107. The energization control device 200 controls an output (i.e., change-over value) in accordance with the operation of the internal combustion based on the detection signal from various sensors (i.e., sensors for detecting the crank angle, the cam angle, the throttle opening degrees, the engine revolution number, the temperature of the engine cooling water, and the vehicle speed) following a predetermined controlling pattern.

Figure 5:
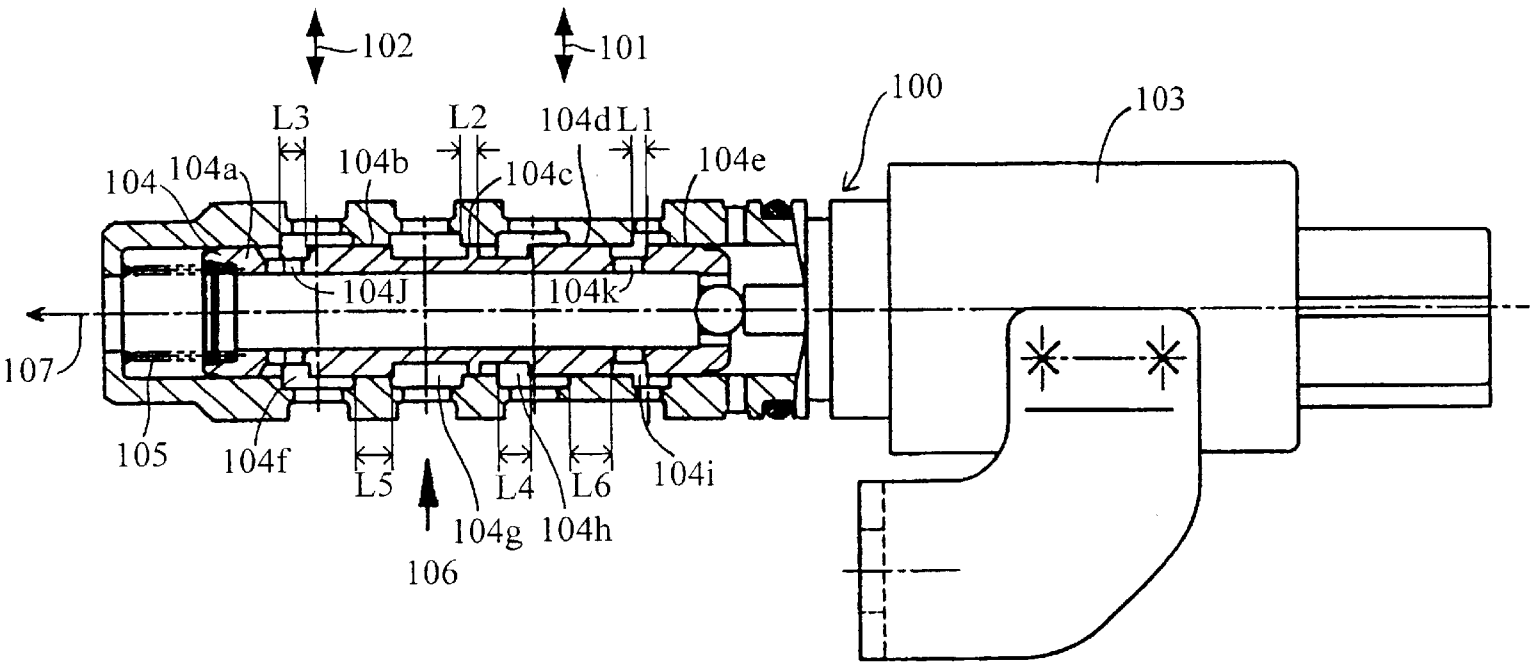
FIG. 5 is an enlarged cross-sectional view of the hydraulic pressure control valve shown in FIG. 1.

As shown in FIG. 5, the spool 104 includes five land portions 104*a*, 104*b*, 104*c*, 104*d*, 104*e*, four annular grooves 104*f*, 104*g*, 104*h*, 104*i* each formed between adjacent pairs of the land portion, and communication bores 104*j*, 104*k* for establishing communication between the annular grooves 104*f*, 104*i* and the drain port 107 respectively. The lap amount (i.e., the lap amount when the stroke amount is zero) of each portion shown in FIG. 5 is predetermined so that L2 is greater than L1, L3 is greater than L2, L4 is greater than L3, L5 is greater than L4, and L6 is greater than L5 (i.e., L1<L2<L3<L4<L5<L6).

When the stroke amount of the spool 104 corresponds to zero and is under the condition shown in FIG. 5 (i.e., the condition that the change-over value is zero percent and is under de-energization ), communication between the supply port 106 connected to an outlet of the oil pump 110 and the advanced angle port 101, and communication between the supply port 106 and the retarded angle portion 102 are blocked respectively by the land portions 104*b*, 104*c*. In addition, the advanced port 101 and the retarded port 102 are in communication with the drain port 107 connected to the oil reservoir 120 via the annular grooves 104*f*, 104*i*, and the communication bores 104*j*, 104*k*. This enables discharge of the operation fluid from the advanced port 101 and the retarded port 102 to the drain port 107. Thus, the operation fluid can be discharged to the oil reservoir 120 from each advanced angle hydraulic chamber R1, each retarded angle hydraulic chamber R2, and the arc shaped lock grooves 21*f*, 21*g* of the relative rotation control mechanism B via the hydraulic pressure control valve 100.

Figure 7A:
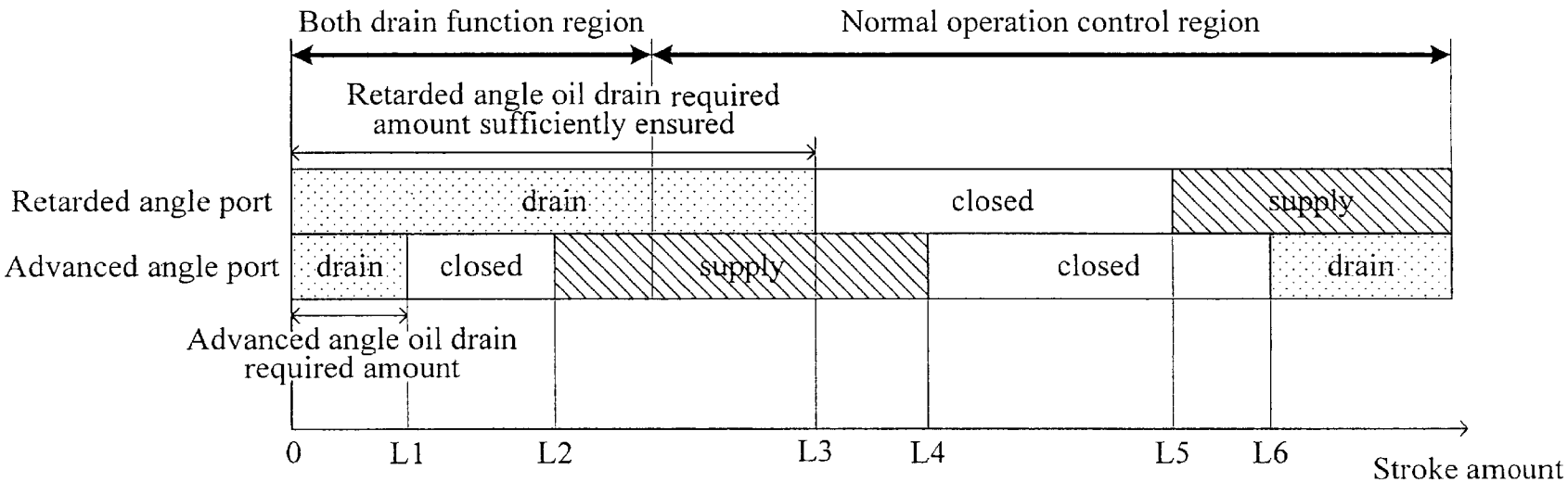
FIG. 7A is a chart showing the relationship of the communication of the advanced angle port and the retarded angle port with the hydraulic pressure control valve shown in FIG. 5.

Referring to FIG. 7A, when the stroke amount of the spool 104 is greater than L1 and less than L2, communication between the supply port 106 and both the advanced angle port 101 and retarded angle port 102 is blocked by the land portions 104*b*, 104*c* respectively. The retarded angle port 102 is in communication with the drain port 107 via the annular groove 104*f* and the communication bore 104*j* so that the operation fluid is discharged from the retarded angle portion 102 to the drain port 107. The communication between the advanced angle port 101 and the drain port 107 is blocked by the land portions 104*d*, 104*e*. Thus, the operation fluid can be discharged from the retarded angle hydraulic chamber R2 and the arc shaped lock groove 21*g* of the relative rotation control mechanism B via the hydraulic pressure control valve 100 and the operation fluid can be sealed in the advanced angle hydraulic chamber R1 and the arc shaped lock groove 21*f* of the relative rotation control mechanism B.

When the stroke amount of the spool 104 is greater than L2 and less than L3, as shown in FIG. 7A, the supply port 106 is in communication with the advanced angle port 101 via the annular groove 104*h* while communication between the supply port 106 and the retarded angle port 102 is blocked by the land portion 104*b*. The retarded angle port 102 is in communication with the drain port 107 via the annular groove 104*f* and the communication bore 104*j*. Thus, the operation fluid can be supplied from the supply port 106 to the advance port 101 and the operation fluid can be discharged from the retarded angle port 102 to the drain port 107. Accordingly, the operation fluid can be supplied to the advanced angle hydraulic chamber R1 and the-arc shaped lock mechanism 21*f* of the relative rotation control mechanism B via the hydraulic pressure control valve 100, and the operation fluid can be discharged from the retarded angle hydraulic chamber R2 and the arc-shaped lock groove 21*g* of the relative rotation control mechanism B to the oil reservoir 120 via the hydraulics pressure control valve 100.

When the stroke amount of the spool 104 is greater than L3 and less than L4, as shown in FIG. 7A, the supply port 106 is in communication with the advanced angle port 101 via the annular groove 104*h* while communication between the supply port 106 and the retarded angle port 102 is blocked by the land portion 104*b*. Communication between the retarded angle port 102 and the drain port 107 is blocked by the land portion 104*b*. Thus, the operation fluid can be supplied from the supply port 106 to the advanced angle port 101. Accordingly, the operation fluid can be supplied to the advanced angle hydraulic chamber R1 and the arc-shaped lock mechanism 21*f* of the relative rotation control mechanism B via the hydraulic pressure control valve 100, and the operation fluid can be sealed in the retarded angle hydraulic chamber R2 and the arc-shaped groove 21*g* of the relative rotation control mechanism B.

When the stroke amount of the spool 104 is greater than L4 and less than L5, as shown in FIG. 7A, communication between the supply port 106 and the advanced angle portion 101 and the retarded angle portion 102 is blocked by the land portions 104*b*, 104*d*. In addition, communications between the advanced angle port 101 and the drain port 107, and between the retarded angle port 102 and the drain port 107 is blocked by the land portions 104*b*, 104*d*, 104*e*. Accordingly, the operation fluid is sealed in the advanced angle hydraulic chamber R1, the retarded angle hydraulic chamber R2, and the arc-shaped lock grooves 21*f*, 21*g* of the relative rotation control mechanism B.

When the stroke amount of the spool 104 is greater than L5 and less than L6, as shown in FIG. 7A, the supply port 106 is in communication with the retarded angle port 102 via the annular groove 104*g* while communication between the supply port 106 and the advanced angle port 101 is blocked by the land portion 104*d*. Communication between the advanced angle port 101 and the drain port 107 is blocked by the land portions 104*d*, 104*e*. The operation fluid can be thus supplied from the supply port 106 to the retarded angle port 102. Accordingly, the operation fluid can be supplied to the retarded angle hydraulic chamber R2 and the arc-shaped lock mechanism 21*g* of the relative rotation control mechanism B via the hydraulic pressure control valve 100 while the operation fluid is sealed in the advanced angle hydraulic chamber R1 and the relative rotation control mechanism B.

When the stroke amount of the spool 104 is greater than L6, as shown in FIG. 7A, the supply port 106 is in communication with the retarded angle port 102 via the annular groove 104*g* while communication between the supply port 106 and the advanced angle port 101 is blocked by the land portion 104*d*. The advanced angle port 101 is in communication with the drain port 107 via the annular groove 104*i* and the communication bore 104*k*. Thus, the operation fluid is supplied from the supply port 106 to the retarded angle port 102, and the operation fluid can be discharged from the advanced angle port 101 to the drain port 107. Accordingly, the operation fluid can be supplied to the retarded angle hydraulic chamber R2 and the arc-shaped lock groove 21*g* of the relative rotation control mechanism B via the hydraulic pressure control valve 100, and the operation fluid can be discharged from the advanced angle hydraulic chamber R1 and the arc-shaped lock groove 21*f* of the relative rotation control mechanism B via the hydraulic pressure control valve 100.

According to the described and illustrated embodiment of the valve timing control device as shown in FIG. 5 and FIG. 7A, the hydraulic pressure control valve 100 (i.e., the variable type electromagnetic spool valve) includes different discharge opening widths (i.e., L3, L5 of FIG. 5) at the both drain function region (dual drain function region) in which the operation fluid is discharged from each advanced angle hydraulic chamber R1 and each retarded angle hydraulic chamber R2. Also, the opening on the retarded angle port 102 side in communication with the retarded angle hydraulic chamber R2, whose volume at idling of the internal combustion engine is relatively large, is larger than the opening on the advanced angle port 101 side. According to the hydraulic pressure control valve 100, the both drain function region is formed on the de-energization stroke end side of the spool 104.

The both drain function region is defined to include the range at which both the advanced angle port and the retarded angle port are under the draining condition and the range during a preparation procedure of either one of the advanced angle port and the retarded angle port (i.e., the advanced angle port in this embodiment) that is to be switched from the supply condition to the drain condition via the closed condition.

With respect to the valve timing control device constructed in the manner described above, the relative rotation phase of the rotor member 20 with respect to the housing member 30 can be adjusted to be maintained at the arbitrary phase between the most retarded angle phase (i.e., the phase in which the volume of the advanced angle hydraulic chamber R1 becomes a minimum and the volume of the retarded angle hydraulic chamber R2 becomes a maximum) and the most advanced angle phase (i.e., the phase in which the volume of the advanced angle hydraulic chamber R1 becomes a maximum and the volume of the retarded angle hydraulic chamber R2 becomes a minimum) by controlling the energization of the solenoid 103 of the hydraulic pressure control valve 100 by the energization control device 200 during the driving operation of the internal combustion engine. Thus, the valve timing of the intake valve during the driving of the internal combustion engine can be adjusted to be maintained between the operation under the most retarded angle control condition and the operation under the most advanced angle control condition.

The adjustment of the relative rotation phase of the rotor member 20 relative to the housing member 30 to the advanced angle side is performed by supplying the operation fluid to the advanced angle hydraulic chamber R1 and the arc-shaped lock groove 21*f* of the relative rotation control mechanism B via the hydraulic pressure control valve 100, and by draining the operation fluid from the retarded angle hydraulic chamber R2 and the arc-shaped lock groove 21*g* of the relative rotation control mechanism B via the hydraulic pressure control valve 100 by determining the stroke amount of the spool 104 to be greater than L2 and less than L3.

In this case, the rotor member 20 is relatively rotated to the advanced angle side relative to the housing member 30 by the supply of the operation fluid to the advanced angle hydraulic chamber R1 and the discharge of the operation fluid from the retarded angle hydraulic chamber R2 under the condition that the lock pin 61 performs the unlocking operation against the lock spring 63 to be retracted and accommodated in the retraction communication bore 32*a* by the supplying of the operation fluid to the arc-shaped lock groove 21*f* of the relative rotation control mechanism B or the condition that the lock pin 61 slidably contacts the end surface of the main rotor 21, and under the condition that the lock pin 62 slidably contacts the end surface of the main rotor 21 or the condition that the lock pin 62 is slidably fitted in the arc-shaped groove 21*g*.

The adjustment of the relative rotation phase of the rotor member 20 relative to the housing member 30 to the retarded angle side is performed by supplying the operation fluid to the retarded angle hydraulic chamber R2 and the arc-shaped lock groove 21*g* of the relative rotation control mechanism B via the hydraulic pressure control valve 100 and by draining the operation fluid from the advanced angle hydraulic chamber R1 and the arc-shaped lock groove 21*g* of the relative rotation control mechanism B via the hydraulic pressure control valve 100.

In this case, the rotor member 20 is rotated to the retarded angle side relative to the housing 30 by supplying the operation fluid to the retarded angle hydraulic chamber R2 and by draining the operation fluid from the advanced angle hydraulic chamber R1 under the condition that the lock pin 62 performs the unlocking operation against the lock spring 64 to be retracted and accommodated in the retraction communication bore 32*b* by supplying the operation fluid to the arc-shaped lock groove 21*g* of the relative rotation control mechanism B or the condition that the lock pin 62 slidably contacts the end surface of the main rotor 21, and the condition that the lock pin 61 slidably contacts the end surface of the main rotor 21 or the condition that the lock pin 61 is slidably fitted in the arc-shaped lock groove 21*f*.

With the disclosed embodiment of the valve timing control device, the energization of the solenoid 103 of the hydraulic pressure control valve 100 by the energization control device 200 is controlled following a predetermine control pattern. It is predetermined that the hydraulic pressure control valve 100 is operated with zero percentage of change-over value for a predetermined time (i.e., the time slightly longer than the cranking of the crankshaft by the starter) to drain the operation fluid from the advanced angle hydraulic chamber R1 and the retarded angle hydraulic chamber R2 and from the arc-shaped lock grooves 21*f*, 21*g* of the relative rotation control mechanism B via the hydraulic pressure control valve 100 at the starting of the internal combustion engine.

Thus, the residual operation fluid in the advanced angle hydraulic chamber R1 and the retarded angle hydraulic chamber R2 can be drained at the start of the internal combustion engine, the relative rotation between the housing member 30 and the rotor member 20 is not disturbed by the operation fluid, and the rotor member 20 can be swiftly rotated to the intermediate phase position between the most advanced angle phase position and the most retarded angle phase position relative to the housing 30 in accordance with the torque fluctuation of the drive train. In addition, because the operation fluid can be drained from the arc-shaped lock grooves 21*f*, 21*g* of the relative rotation control mechanism B at the starting of the internal combustion engine, proper lock operation (i.e., pushing the lock pins 61, 62 by the respective lock springs 63, 64) can be achieved at the relative rotation control mechanism B, and the relative rotation between the rotor member 20 and the housing member 30 can be properly restricted at the intermediate phase position. Accordingly, the starting performance of the internal combustion engine can be improved.

In the described and illustrated embodiment of the valve timing control device, the hydraulic pressure control valve 100 (i.e., variable type electromagnetic spool valve) includes different draining opening widths (L1, L3 of FIG.

5) at the both drain function region during which the operation fluid can be drained from the advanced angle hydraulic chamber R1 and the retarded angle hydraulic chamber R2. In addition, the opening on the retarded angle port 102 side in communication with the retarded angle hydraulic chamber R2, whose volume is relatively large at the idling of the internal combustion engine, is larger than the opening on the advanced angle port 101 side. Thus, the both drain function region as a whole can be smaller while including the function for properly draining the operation fluid (i.e., which may include air) remaining in the retarded angle hydraulic chamber R2 which has a larger volume at the idling of the internal combustion engine. Accordingly, the stroke amount of the spool 104 and the solenoid 103 can be smaller, thus reducing the size of the hydraulic pressure control valve 100 (i.e., the variable type electromagnetic spool valve) while also reducing the manufacturing cost.

In the described and illustrated version of the variable valve timing control device, the spool 104 is controlled to be at the position to form the both drain function region during de-energization (i.e., the both drain function region is formed on the de-energization stroke end side of the spool 104) of the hydraulic pressure control valve 100 (i.e., the variable type electromagnetic spool valve). Thus, even during de-energization due to an electric abnormality, the function equal to that associated with the normal condition can be obtained at the starting of the combustion engine and the internal combustion engine can be kept driven under the condition that the relative rotation control mechanism B restricts the relative rotation of the rotor 20 with respect to the housing member 30 at the intermediate phase position between the most advanced angle phase position and the most retarded angle phase position (i.e., the condition that the function which is the minimum requisite for the internal combustion engine can be performed).

The aforementioned electric abnormality condition includes a sensing abnormality due to the disconnection of the various sensors (i.e., the sensors for detecting the crank angle, the cam angle, the throttle openings, the engine revolution number, the engine cooling water, and the vehicle speed), a hydraulic pressure shortage, a control performance defect of the hydraulic pressure control valve 100 due to the entrapment of obstacles, and an energization abnormality of the hydraulic pressure control valve 100 due to disconnection.

Figure 6:
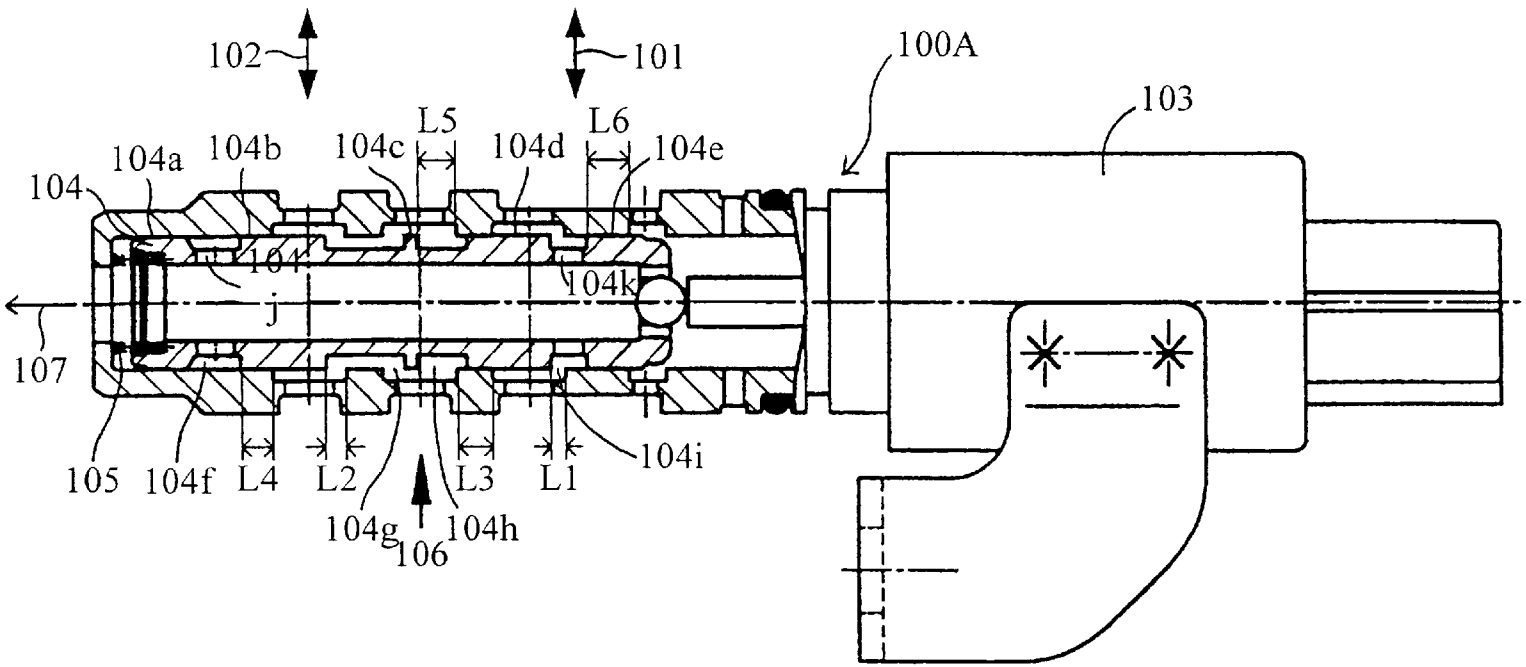
FIG. 6 is a cross-sectional view of an another embodiment hydraulic pressure control valve.

According to the embodiment described above, the variable type electromagnetic spool valve is adopted as the control valve 100 of the hydraulic pressure circuit C as shown in FIGS. 5 and 7A. According to another embodiment shown in FIGS. 6 and 7B, a control valve 100A (variable type electronic spool valve) can be adopted in place of the control valve 100. The control valve 100A is substantially the same as the control valve 100 except that both drain function regions are formed when the spool 104 is controlled to be at the maximum moving position during the energization and the spool 104 forms the supply-drain function region during the de-energization (i.e., the both drain function region is formed on the energization stroke end side of the spool 104 and the supply-drain function region is formed on the de-energization stroke end side of the spool 104). Thus, features of the control valve 100A shown in FIG. 6 corresponding to those shown in the FIG. 5 version of the control valve 100 are designated by the same reference numerals and a detailed description of such features is not repeated. FIG. 6 shows the condition in which the spool 104 is under de-energization.

Figure 7B:
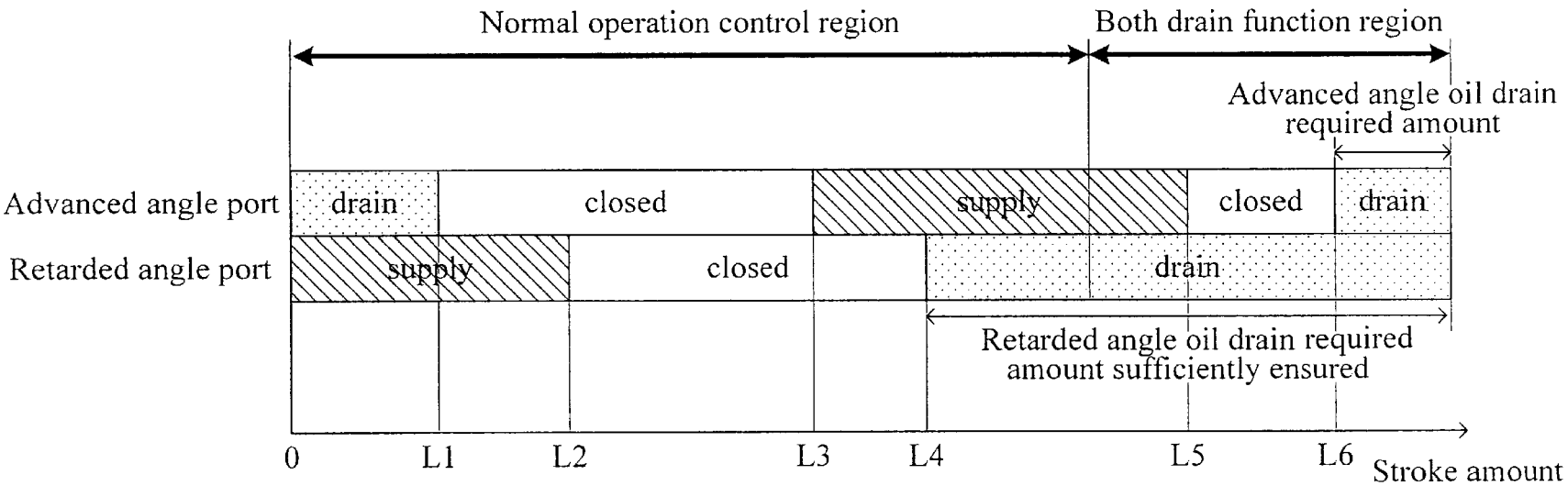
FIG. 7B is a chart showing the relationship of the communication of the advanced angle port and the retarded angle port with the hydraulic pressure control valve shown in FIG. 6.

With the embodiment of the control valve 100A shown in FIG. 5 and FIG. 7B, even during de-energization due to an electric abnormality, the supply-drain function can be obtained for fixedly maintaining the relative rotation of the rotor member 20 and the housing member 30 at the most retarded angle phase position. Thus, the internal combustion engine can be kept driven under the condition with less defect at starting and idling.

Although the variable valve timing control device described above is constructed to have a housing member unitarily rotated with the crankshaft, and the rotor member 20 is unitarily rotated with the camshaft 10, the housing member may be rotated as one unit with the camshaft and the rotor member may be rotated as one unit with the crankshaft. Moreover, the variable valve timing control device can be applied to a type of device in which the vanes are unitarily formed on the rotor.

The variable valve timing control device is described in the context of an intake valve equipped on the camshaft, the variable valve timing control device may be applied to the camshaft for opening and closing the exhaust valve. With the variable valve timing control device equipped on the camshaft for opening and closing the exhaust valve, the volume of the advanced angle hydraulic pressure chamber becomes greater than the retarded angle hydraulic chamber at the idling of the internal combustion engine. Thus, the advanced angle port 101 of the control valve 100 or 100A is replaced with the retarded angle port, and the retarded angle port 102 is replaced with the advanced angle port to be assembled in the hydraulic pressure circuit C.

In the embodiments of the variable valve timing control device described above and illustrated in the drawing figures, the operation fluid can be drained from the advanced angle hydraulic chamber, the retarded angle hydraulic chamber, and from the relative rotation control mechanism at the start of the internal combustion engine. Thus, residual operation fluid in the advanced angle hydraulic chamber and the retarded angle hydraulic chamber can be discharged at the start of the internal combustion engine, the relative rotation between the housing member and the rotor member is not disturbed, and the rotor member can be swiftly rotated to be at the intermediate phase position between the most advanced angle phase position and the most retarded angle phase position relative to the housing member. In addition, the operation fluid can be discharged from the relative rotation control mechanism at the start of the internal combustion engine, the proper locking operation is performed at the relative rotation control mechanism, and the relative rotation between the housing member and the rotor member can be properly restricted at the intermediate phase position. Accordingly, the starting performance of the internal combustion engine is improved.

With the described and illustrated embodiments of the variable valve timing control device, because the variable type electromagnetic spool valve includes different exhaust opening widths at the both drain function region in which the operation fluid can be drained from the advanced angle hydraulic chamber and the retarded angle hydraulic chamber, and the opening on the hydraulic passage side in communication with the retarded angle hydraulic chamber or the advanced angle hydraulic chamber whose volume is relatively large at idling of the internal combustion engine is determined to be large, the both drain function region as a whole can be reduced while maintaining the function for properly draining the operation fluid (i.e., which may include air) remaining in the hydraulic chamber determined to have a larger volume at idling of the internal combustion engine. Accordingly, the stroke amount of the spool and the size of the solenoid of the variable type electromagnetic spool valve can be reduced, thus reducing the size of the variable type electromagnetic spool valve as a whole and reducing the manufacturing cost.

With the disclosed embodiments of the variable valve timing control device, when it is controlled that the spool forms the both drain function region during de-energization of the variable type electromagnetic spool, the function equivalent to the normal operation can be obtained at the start of the internal combustion engine even when the de-energization is caused by virtue of an electric abnormality. Thus, the internal combustion engine can be kept driven under the condition that the relative rotation control mechanism restricts relative rotation between the housing member and the rotor member at the intermediate phase position between the most advanced angle phase position and the most retarded angle phase position.

In the variable valve timing control device described above, the both drain function region is formed when the spool is controlled to be at the maximum moved position during energization of the variable type electromagnetic spool valve and when the spool forms the supply-drain function region during de-energization of the variable type electromagnetic spool valve. In this case, even if the de-energization is caused because of an electric abnormality, the supply-drain function can be performed at the variable type electromagnetic spool valve, the relative rotation between the housing member and the rotor member can be fixed to be maintained either at the most advanced angle phase position or the most retarded angle phase position to keep driving the internal combustion engine with less defect at starting and idling (i.e., the most retarded angle phase position at the valve timing of the intake valve and the most advanced angle phase position at the valve timing of the exhaust valve).

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A variable valve timing control device comprising:

a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft;

a rotor member relatively rotatably assembled in the housing member to form a hydraulic pressure chamber with the housing member, the rotor member having a vane portion dividing the hydraulic pressure chamber into an advanced angle hydraulic chamber and a retarded angle hydraulic chamber;

a relative rotation control mechanism allowing relative rotation between the housing member and the rotor member by performing an unlocking operation through supply of an operation fluid and restricting relative rotation between the housing member and the rotor member at an intermediate phase position between a most advanced angle phase position and a most retarded angle phase position through discharge of the operation fluid;

a hydraulic pressure circuit controlling the supply and discharge of the operation fluid with respect to the advanced angle hydraulic chamber and the retarded angle hydraulic chamber and controlling the supply and discharge of the operation fluid with respect to the relative rotation control mechanism;

a control valve provided in the hydraulic pressure circuit, the control valve discharging the operation fluid from the advanced angle hydraulic chamber and the retarded angle hydraulic chamber and from the relative rotation control mechanism;

the control valve including a variable electromagnetic spool valve having different exhaust opening widths at a both drain function region in which the operation fluid is discharged from the advanced angle hydraulic chamber and the retarded angle hydraulic chamber and having a larger opening for a passage in communication with the retarded angle hydraulic chamber or the advanced angle hydraulic chamber whose volume is relatively large at idling of the internal combustion engine.

2. The variable valve timing control device according to claim 1, wherein the variable electromagnetic spool valve includes a spool controlled to be at a position forming the both drain function region during de-energization of the variable type electromagnetic spool valve.

3. The variable valve timing control device according to claim 1, wherein the both drain function region is constituted by the spool being at a maximum moved position during energization of the variable type electromagnetic spool valve, the spool forming a supply-drain function region during de-energization of the variable type electromagnetic spool valve.

4. The variable valve timing control device according to claim 1, wherein the vane portion is unitarily formed on a rotor body.

5. The variable valve timing control device according to claim 1, wherein the both function region includes a preparation period during which a drain function for the advanced angle port is performed.

6. A variable valve timing control device comprising:

a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft;

a rotor member relatively rotatably assembled in the housing member to define with the housing member a hydraulic pressure chamber, the rotor member having a vane portion dividing the hydraulic pressure chamber into an advanced angle hydraulic chamber and a retarded angle hydraulic chamber;

a relative rotation control mechanism permitting relative rotation between the housing member and the rotor member by effecting an unlocking operation between the housing member and the rotor member through supply of operation fluid and restricting relative rotation between the housing member and the rotor member at an intermediate phase position between a most advanced angle phase position and a most retarded angle phase position by effecting a locking operation between the housing member and the rotor member through discharge of operation fluid;

a hydraulic pressure circuit controlling the supply and discharge of the operation fluid with respect to the advanced angle hydraulic chamber and the retarded angle hydraulic chamber and controlling the supply and discharge of the operation fluid with respect to the relative rotation control mechanism;

an electromagnetic spool valve provided in the hydraulic pressure circuit, the electromagnetic spool valve including a spool;

the spool being positioned during de-energization of the variable type electromagnetic spool valve at a position forming a both drain function region in which the operation fluid is discharged from the advanced angle hydraulic chamber and the retarded angle hydraulic chamber.

7. The variable valve timing control device according to claim 6, wherein the rotor member includes a rotor body that is unitarily formed with the vane portion.

8. The variable valve timing control device according to claim 6, wherein the rotor member defines with the housing member a plurality of hydraulic pressure chambers, the rotor member having a plurality of vane portions each dividing one of the hydraulic pressure chambers into an advanced angle hydraulic chamber and a retarded angle hydraulic chamber.

9. The variable valve timing control device according to claim 6, wherein the variable type electromagnetic spool valve includes a spring which biases the spool during de-energization of the variable type electromagnetic spool valve to the position forming the both drain function region.

10. A variable valve timing control device comprising:

a housing member provided on a drive train for transmitting a driving force from a crankshaft of an internal combustion engine to a camshaft for opening and closing an intake valve and an exhaust valve of the internal combustion engine for being unitarily rotated with the crankshaft or the camshaft;

a rotor member relatively rotatably assembled in the housing member to define with the housing member a hydraulic pressure chamber, the rotor member having a vane portion dividing the hydraulic pressure chamber into an advanced angle hydraulic chamber and a retarded angle hydraulic chamber;

a relative rotation control mechanism permitting relative rotation between the housing member and the rotor member by effecting an unlocking operation between the housing member and the rotor member through supply of operation fluid and restricting relative rotation between the housing member and the rotor member at an intermediate phase position between a most advanced angle phase position and a most retarded angle phase position by effecting a locking operation between the housing member and the rotor member through discharge of operation fluid;

a hydraulic pressure circuit controlling the supply and discharge of the operation fluid with respect to the advanced angle hydraulic chamber and the retarded angle hydraulic chamber and controlling the supply and discharge of the operation fluid with respect to the relative rotation control mechanism;

an electromagnetic spool valve provided in the hydraulic pressure circuit, the electromagnetic spool valve including a spool moved in response to energization of the electromagnetic spool valve;

the spool being movable to a maximum moved position during energization of the variable type electromagnetic spool valve, the maximum moved position constituting a both drain function region at which the operation fluid is discharged from the advanced angle hydraulic chamber and the retarded angle hydraulic chamber, the spool being positioned during de-energization of the electromagnetic spool valve at a position constituting a supply-drain function region at which operation fluid is supplied to one of the advanced angle hydraulic chamber and the retarded angle hydraulic chamber, and is drained from the other of the advanced angle hydraulic chamber and the retarded angle hydraulic chamber.

11. The variable valve timing control device according to claim 10, wherein the rotor member includes a rotor body that is unitarily formed with the vane portion.

12. The variable valve timing control device according to claim 10, wherein the rotor member defines with the housing member a plurality of hydraulic pressure chambers, the rotor member having a plurality of vane portions each dividing one of the hydraulic pressure chambers into an advanced angle hydraulic chamber and a retarded angle hydraulic chamber.

13. The variable valve timing control device according to claim 10, wherein the variable type electromagnetic spool valve includes a spring which biases the spool during de-energization of the variable type electromagnetic spool valve to the position forming the both drain function region.

14. The variable valve timing control device according to claim 10, wherein the spool includes a plurality of spaced apart lands.

* * * * *